US005769421A

United States Patent [19]

Wakefield

[11] Patent Number: 5,769,421

[45] Date of Patent: Jun. 23, 1998

[54] WORD FORMING GAME

[76] Inventor: Martin A. Wakefield, 199 S. McLean #11, Memphis, Tenn. 38104

[21] Appl. No.: 757,878

[22] Filed: Nov. 27, 1996

[51] Int. Cl.[6] ..... A63F 3/00

[52] U.S. Cl. ..... 273/272; 434/170

[58] Field of Search ..... 273/272; 434/167, 434/170, 171, 172

[56] References Cited

U.S. PATENT DOCUMENTS

| | | | |
|---|---|---|---|
| 3,460,835 | 8/1969 | Crans | 273/272 |
| 3,891,218 | 6/1975 | Hilgartner et al. . | |
| 4,365,813 | 12/1982 | Hirsch . | |
| 4,592,553 | 6/1986 | Mammen et al. | 273/272 |
| 4,892,319 | 1/1990 | Johnson, II . | |
| 4,934,711 | 6/1990 | Runstein . | |
| 5,100,150 | 3/1992 | Larman . | |
| 5,297,801 | 3/1994 | Croker | 273/272 |
| 5,374,065 | 12/1994 | Motskin . | |
| 5,395,118 | 3/1995 | Barrett . | |
| 5,429,371 | 7/1995 | Bledsoe . | |

FOREIGN PATENT DOCUMENTS

| | | |
|---|---|---|
| 2 227 182 | 7/1990 | United Kingdom . |
| 2 227 674 | 8/1990 | United Kingdom . |

*Primary Examiner*—William M. Pierce

*Attorney, Agent, or Firm*—Baker, Donelson,Bearman & Caldwell

[57] ABSTRACT

The present invention is a word forming game which has a letter selection based on words used commonly in conversation. The word game of the present invention may include: one six-sided die; a game board having four player areas, each area numbered one through six to correspond to the numbers on the die; thirty-one letter tiles imprinted with commonly used letters on both sides of the tile; and a score card. According to a method of playing the game of a preferred embodiment, four players place letter tiles next to each number located in the player areas. By rolls of the die, each player selects four of the letters and attempts to form a word. Each player is given preferably eight rounds in which to form words. At the end of the game, the player may receive a bonus score for forming a sentence from the words formed during the game. Generally, each letter used to form a word counts one point. The scorecard is used to record the letters, words and the points. The player at the end of eight rounds with the highest total points is the winner.

20 Claims, 5 Drawing Sheets

WORD FORMING GAME

COPYRIGHT NOTICE

Copyright 1995, Martin A. Wakefield. All Rights Reserved.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates generally to games and more specifically to word forming games.

BACKGROUND

Many existing word forming games, such as Scrabble® and Upwords®, have game pieces or letter tiles imprinted with the letters of an alphabet such as English, Spanish, etc. Players randomly select letter tiles from a pool of tiles and place the tiles on a board to form one or more words. Typically, players must form a word using a letter tile in a previously formed word. Players then may replenish the number of letters previously used to form a word by drawing the same number of letter tiles from the pool of letter tiles.

The quantity of each vowel or consonant in the pool of letter tiles usually reflects the relative frequency of use of each of the letters as they appear in the words of the language. For instance, it is well known that the letter "E" is the most frequently used letter in words of the English language and, therefore, the most frequently occurring letter tile in English language word forming games. However, the frequency of letter usage may vary depending on the source of words. For instance, letter usage may vary between literary text and telegrams, children and adults, or printed text and conversation. Further, letter usage frequency may vary within a single source. As an example, letter usage in conversation may vary dramatically between educated and uneducated adults. Also, usage of technical words, frequently used words, lengthy words, short words or any number of other factors may cause the letter usage frequency to vary. These and other factors which are used by game developers in determining the letter frequency can significantly affect the availability of letters in the letter tile pool, which as a consequence, may directly impact a player's ability to form a word during the game.

A hypothetical word game which bases the letter selection solely upon technical words may prove too difficult for persons having little or no familiarity with the technical words. Conversely, a word game which has a letter selection based on commonly used words, and more particularly, words used commonly in conversation, may provide more word-forming opportunities for persons without a sophisticated technical vocabulary. However, no known word game bases the letter selection upon usage frequency in conversation. Further, no known word game bases the letter selection upon usage frequency of words occurring commonly in conversation.

SUMMARY

The present invention overcomes these and other limitations of known word games by providing a word forming game in which the selection of letters in the letter tile pool is based upon usage frequency of letters in conversation. The letter tile pool preferably is based on usage frequency of common words in conversation so that players have a greater chance during the course of a game to form a word.

The present word game also increases a player's chance to form words during a game by maximizing the chance that at least one vowel is available and minimizing the chance that rarely used letters such as V, X, Z, or Q are selected. To accomplish this goal, at the half-way point of the game, the letter tiles are turned over to reveal a new set of letters. The letters are strategically placed on either side of the letter tile so that vowels will more frequently appear during the entire game while rarely used letters will appear, if at all, during only half of the game.

In a preferred embodiment, the word game of the present invention includes: one six-sided die; a game board having four player areas, each area numbered one through six to correspond to the numbers on the die; thirty-one letter tiles imprinted with letters on both sides of the tile; and a score card. According to a preferred method of playing the game, four players are seated next to each player area, player one next to player one area, etc. The players randomly position twenty-four of the thirty-one letter tiles next to each number located in the player areas.

Beginning at player one area, player one rolls the die. The number rolled on the die corresponds to a number on player one area. Player one records on the score card the letter adjacent the number. For example, if the roll produces a six, the letter adjacent the number six in player one area should be recorded on the score card. On the second, third and fourth rolls, player one similarly records the letter which matches the number in the second, third and fourth player areas, respectively. At the end of four rolls, player one must create one or more words using the four letters only once. Players two, three and four in turn complete the letter selection procedure, each recording the letters and forming a word before passing the die to the next player. In this embodiment, one round is completed once each player has rolled the die four times.

Optionally, to provide a faster game, players two, three and four record letters simultaneously with player one. For example, if a roll produces a 5, each player would record the letter in his or her own player area that is adjacent the number 5. Thus, after player one has rolled four times, each player will have selected four letters to form a word. In this particular embodiment, a player may challenge another player's letter selection if he or she believes the player chose incorrect letters. In this embodiment a round is completed after a player has completed four rolls.

Typically, each player selects the first letter from his or her player area and progresses around the board either clockwise or counterclockwise after each roll. After four rounds and before the fifth, the tiles are turned over to reveal the set of letters imprinted on the reverse side of the tiles. Play continues as before for four more rounds until eight total rounds have been completed. Generally, each letter used to form a word counts one point. The player at the end of eight rounds with the highest total points is the winner.

In a particularly preferred embodiment, the present word game and method may include several scoring and play bonuses. Specifically, one or more of the letter tiles may be phantom tiles. A phantom tile typically allows a player to choose any letter from the current player area. Another type of phantom tile allows a player to choose any letter from the entire board. Yet another type of tile may be a pointing finger tile. As the name implies, this tile has fingers which point to the left and right side of the tile. This tile allows a player to choose a letter on either side of the pointing finger tile. Yet another type of tile is the suffix/prefix tile. This tile allows a player, at the end of eight rounds, to extend any word with a suffix or prefix, or both, before making a sentence. Other tiles such as the bomb tile causes a player to forfeit that round, and a bonus tile may increase a player's score for forming a word.

A further embodiment includes a sentence forming scoring bonus. If a player can make a sentence from the words formed during the eight rounds of play, that player may add five points per word to his or her total score.

Other options include a letter saving box located on the score card. If a player uses less than four letters to form a word, the player may save the remaining letters by recording them in the letter saving box. The letters recorded in the letter recording box may be used to assist the player in forming a word during subsequent rounds. In a preferred embodiment, letters can only be saved for the next round. In a particularly preferred embodiment, only consonants and not vowels may be saved. The letter saving option allows the player the ability to form words having more than four letters.

Therefore, a purpose of the present invention is to provide a word game using letters selected from words used frequently in conversation.

Another purpose of the present word game and method is to provide a selection of letter tiles for maximizing the chance of selecting one or more vowels while minimizing the chance of selecting rarely occurring letters.

Another purpose of the present invention is to increase the player's chances of selecting letters which can be used to form a word.

Yet another purpose of the present invention is to give a player several chances during the game to form words.

Yet another purpose of the present word game and method is to provide a sentence forming option.

Another purpose of the present invention is to provide a word game with various bonus and scoring options.

These and other purposes and advantages of the present invention will be apparent from the following description, drawings and appended claims.

DETAILED DESCRIPTION

Game Components

Figure 1:
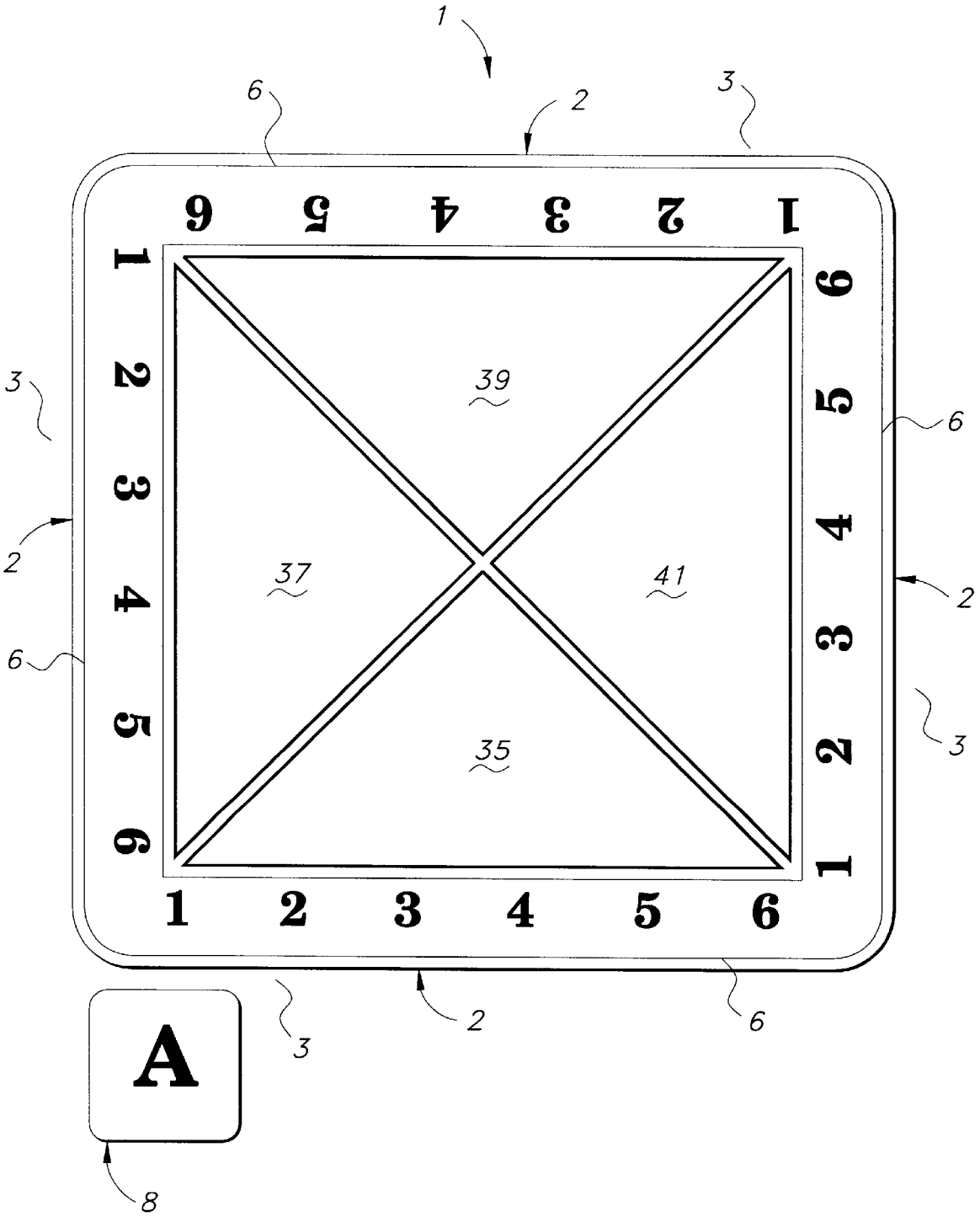
FIG. 1 is a top view illustrating features of a preferred embodiment of a game board according to the present invention.

Referring to FIGS. 1–6, a preferred embodiment of the word game of the present invention comprises a game board 1 having four player areas 2, a group 7 of thirty-one letter tiles 8, a score card 23, and a six-sided die (not shown). Each letter tile 8 has a first side and a second side. Typically, each side is imprinted with a letter. The letter tiles 8 as well as the game board 1 are constructed of a suitable material such as cardboard or plastic.

The player areas 2 may each occupy a triangular section of the game board 1, and are typically designated by different colors. In a particularly preferred embodiment, player one area 35 is designated by the color black, player two area 37 by red, player three area 39 by yellow, and player four area 41 by blue. Each player area 2 has a numbered area 6 which is preferably numbered one through six to correspond to the numbers which may be rolled by the die. Adjacent to player areas 2 and along and outside the perimeter of the game board 1 are tile placement areas 3. The tile placement areas 3 may also be incorporated as part of the game board 1.

Game Play

Figure 6:
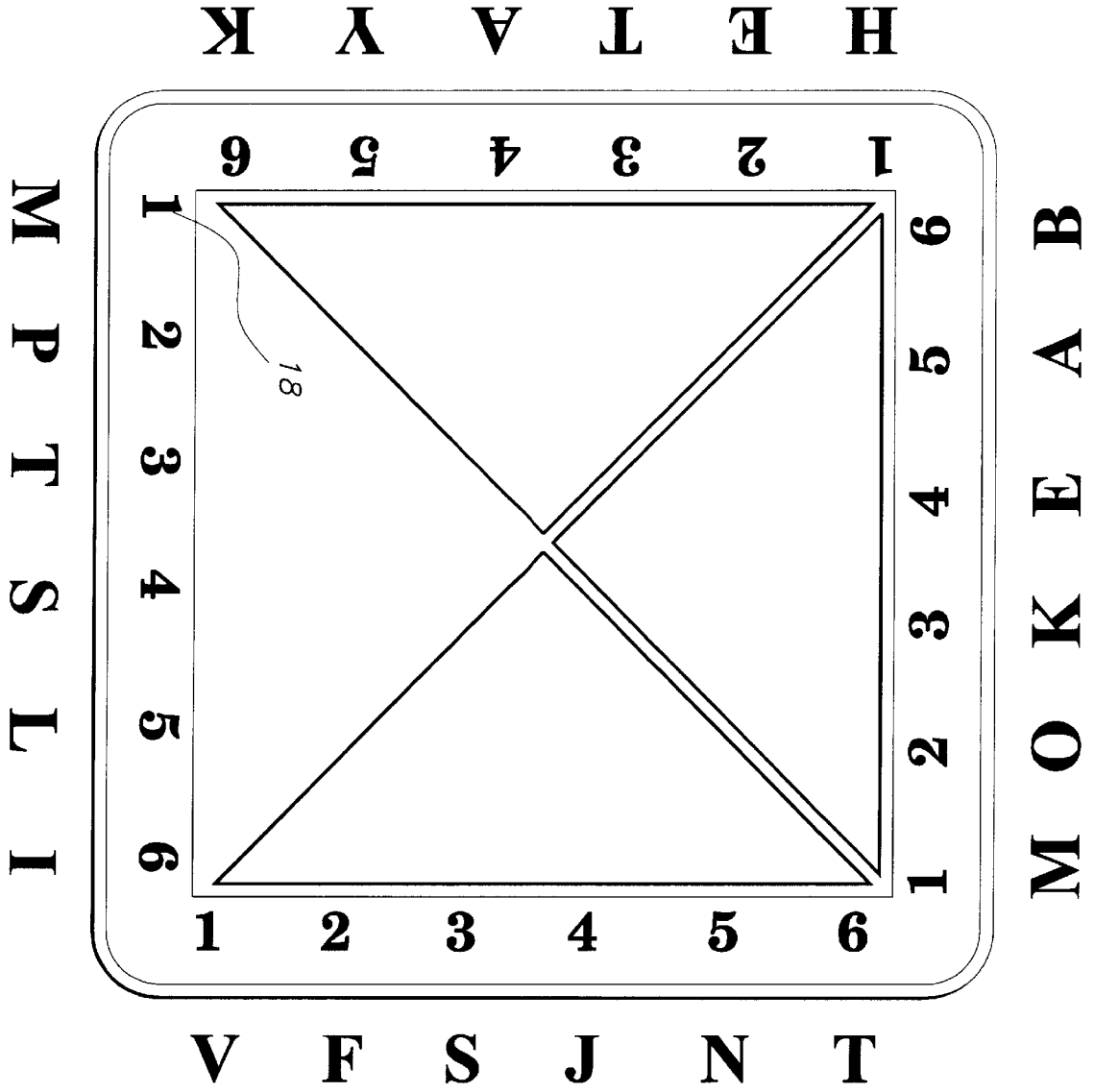
FIG. 6 is a top view of the game board shown in FIG. 1 with letter tiles placed in the tile placement area.

Referring to FIG. 6, twenty-four of the thirty-one letter tiles 8 are randomly drawn and positioned in the tile placement areas 3 so that a letter tile 8 is adjacent to each number 18 in the number areas 6. Seven letter tiles 8 remain unselected. Preferably, if there are fewer than three vowels displayed in the letter tile area 3, a designated player may remove a predetermined number of consonants and replace them with vowels from the unselected letter tiles. Player one (not shown) is seated next to player one area 35, player two (not shown) next to player two area 37 and so on. Beginning at player one area 35, player one rolls the die and records on the score card 23 the letter adjacent the number which was rolled on the die. For example, if the roll produces a six, the letter adjacent the number six should be recorded on the score card 23. On the second, third and fourth rolls, player one similarly records the letter which matches the number in the second, third and fourth player areas, respectively. At the end of four rolls, player one may create one or more words using the four letters only once. Players two, then three, then four each complete four rolls and similarly select and record letters beginning from their respective player areas and proceeding to their left around the board. A round is complete after each player has rolled the die four times.

Optionally, to provide a faster game, players two, three and four record letters simultaneously with player one. For example, if a roll produces a 5, each player would record the letter in his or her own player area that is adjacent the number 5. Thus, after player one has rolled four times, each player will have selected four letters to form a word. In this embodiment, a round is complete after a player rolls the die four times. Also, a player may preferably challenge another player's letter selection if he or she believes the other player chose incorrect letters.

The letters are recorded in the letter recording boxes 25 located on the score card 23. Once four letters have been recorded, player one may form and record one or more words on the word recording line 29 next to the letter recording boxes 25.

Figure 5:
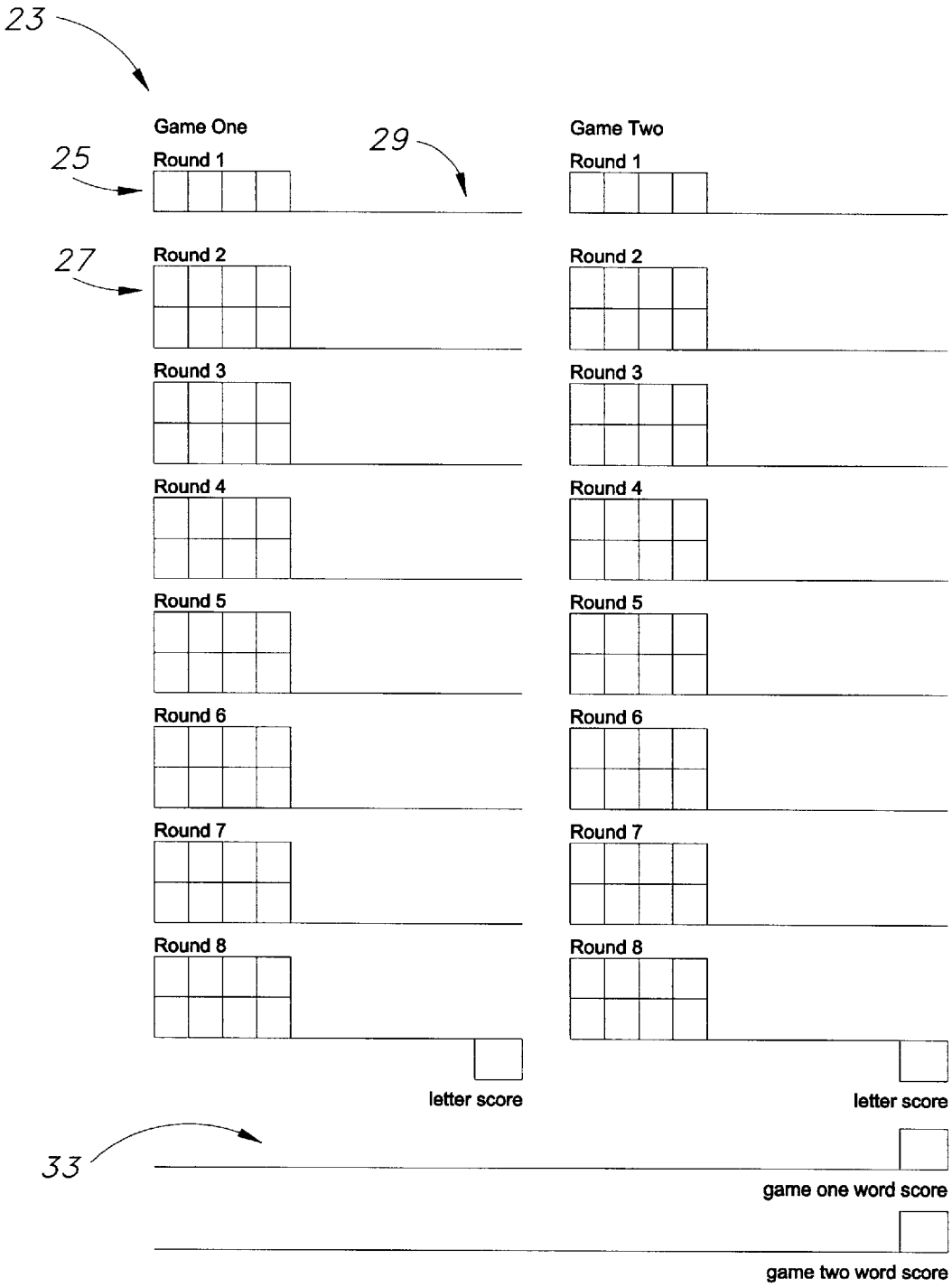
FIG. 5 is a top view of a typical score card used in the word game of the present invention.

After four rounds, the players turn over the letter tiles 8 in place to reveal the new set of letters imprinted on the opposite side. Rounds five through eight are played just as rounds one through four. As shown in FIG. 5, the score card 23 may contain a sentence recording line 33. Once eight rounds are completed, each player may attempt to form a sentence using the words formed during the previous eight rounds. Preferably, a player may use the articles "a," "an," or "the" to form the sentence.

While any number of scoring options may suffice, typically each letter used to form a word counts one point, while each word used to form a sentence counts five points. Articles are scored as zero, unless formed during the rounds. The player with the highest total score wins.

Figure 2:
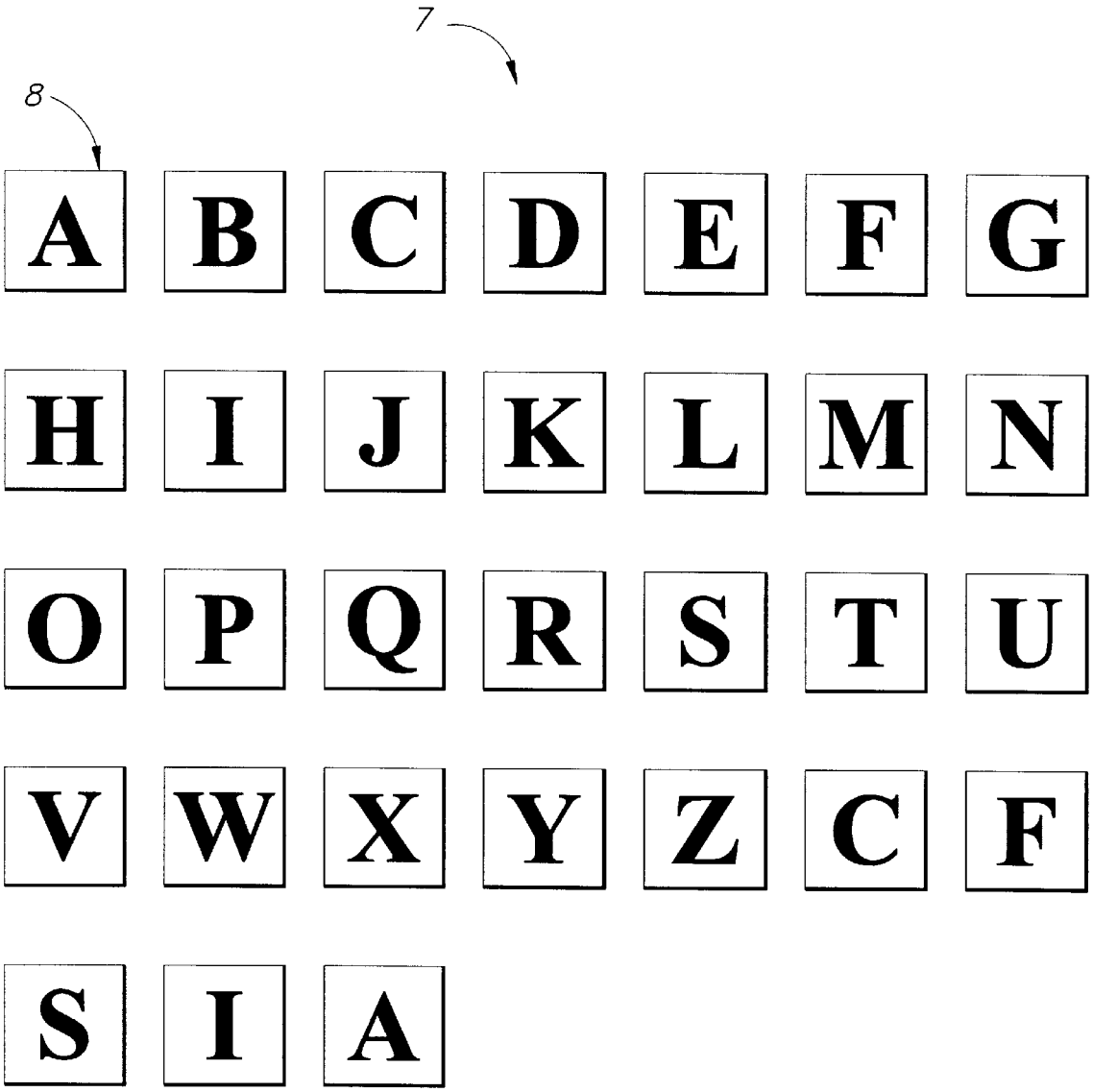
FIG. 2 is a top view of the first side of the letter tiles of one embodiment of the present word game.
Figure 3:
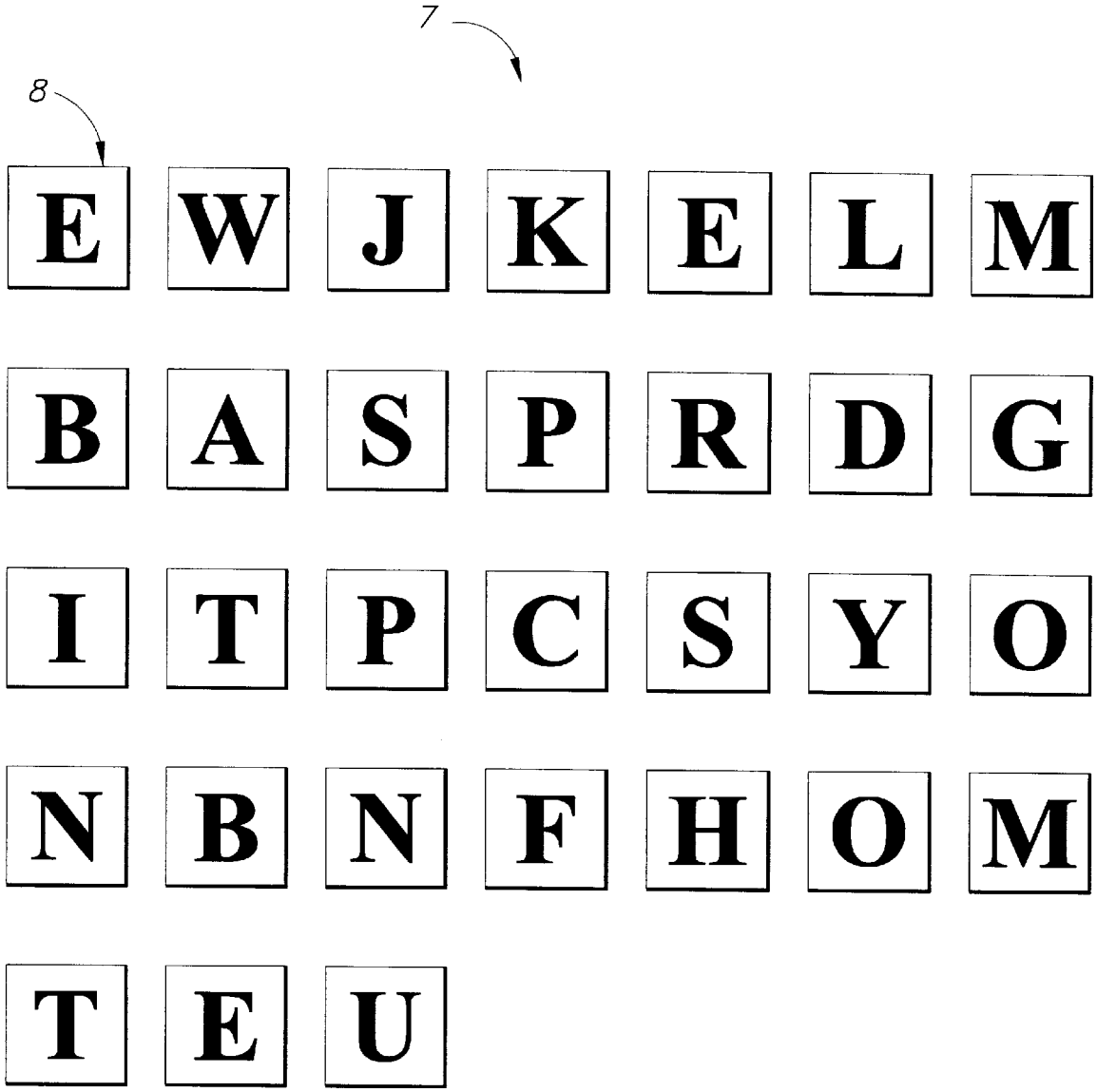
FIG. 3 is a top view of the second side of the letter tiles shown in FIG. 2.
Figure 4:
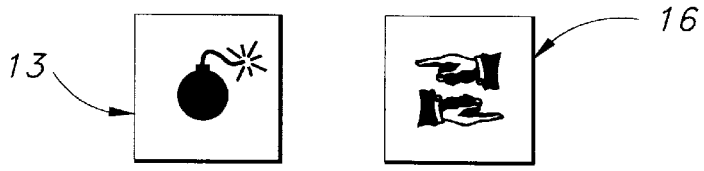
FIG. 4 is a top view of a typical bomb tile and pointing finger tile of the present word game.

Referring to FIGS. 2 and 3, the letter tiles 8 are imprinted with letters, preferably of the English alphabet, found in words commonly used during conversation. Extensive surveys were conducted by listening to conversations and recording the words used in the conversations. Data from the surveys were analyzed to determine the length of commonly used words and the letters which form those words. Words ranging from three to seven letters were found to occur most often during conversation. The combination of 62 letters of the present game, as illustrated in FIGS. 2 and 3, accurately represents the proportion of letters found in the most commonly used words as indicated by the surveys. The relative frequency of the letters is as follows: the commonly used consonants B, C, D, F, G, H, J, K, L, M, N, P, R, S, T, W, and Y occur, with a total frequency of about 70 percent; the vowels A, I, E, O, and U, occur with a total relative frequency of about 24 percent; and the rarely used consonants, Q, V, X, and Z occur with a total relative frequency of about 6 percent.

While the number and proportion of letters were selected based on the survey data, the particular placement of the letters on each letter tile represents an arrangement to maximize the chance that at least one vowel will be available and minimize the chance that rarely used letters such as Q, V, X, or Z will be selected. As described above, the letter tiles are turned over after round four to reveal a new set of letters. The letters for each side of the tile are selected so that vowels will most likely appear during the entire game while rarely used letters will appear, if at all, during only four rounds of the game.

FIG. 2 shows the first side of each letter tile. The letters in FIG. 3 in corresponding positions are imprinted on the opposite side of the tiles. As an example, a tile 8 imprinted with "A", the letter in the upper left of FIG. 2, may have the letter "E", the letter in the upper left of FIG. 3, imprinted on the reverse side. Therefore, when this tile is turned over after round four, a vowel remains an available selection for the remaining four rounds. However, since fifteen vowels are provided in the illustrated set of letters, one vowel "O" is paired with a consonant "C." Similarly, the tiles with rarely used letters, "V", "Q", "X", and "Z" have the letters "N", "P", "N" and "H", respectively, imprinted on the reverse side. Therefore, the rarely used letters will be available during only four rounds of the game.

The preferred embodiment described above may have feature tiles such as a phantom tile (not shown), a pointing finger tile 16, a suffix/prefix tile (not shown), and a bomb tile 13. The feature tiles are included in the pool of letter tiles and may be placed on the tile placement areas 3 and selected according to the roll of the die.

The phantom tile allows a player to chose any letter from the current row of tiles. In another embodiment, the phantom tile may allow a player to select a letter from any letter row. The pointing finger tile 16 permits a player to select the letter on either side of the pointing finger tile 16. If the pointing finger tile 16 is in the one position, a player may choose a letter from position two or six from the same row. Similarly, if the pointing finger tile 16 is in the six position, the player may choose the letter in the one or five position from the same row. The suffix/prefix tile allows a player to add a suffix or prefix, or both, to one word formed during the eight rounds prior to forming a sentence. When the suffix/prefix tile is selected, the player removes it from the tile placement area 3 for the remainder of the game, and replaces it with a letter tile 8. The player who selects the bomb tile 13 forfeits the round and cannot form a word. Preferably, that player cannot transfer any letter to the next round.

Other features of the present word game may include bonus point tiles (not shown) or letter saving boxes 27 on the score card 23. Bonus point tiles have a preset value and increase the number of points awarded to a player for forming a word and preferably can only be used once per game. The letter saving boxes 27 allow a player to save unused letters to form words in later rounds. In a preferred embodiment, any letter which is saved by a player may only be used in the next round. In a particularly preferred embodiment, only consonants, and not vowels, may be saved. In yet another embodiment, a player may be prohibited from spelling the same word twice in one game.

The game board 1 may vary substantially in appearance and function from that described above and shown in FIGS. 1 and 6. The game board 1 may be of a size and shape to accommodate many more than four players such as octagonal in shape for eight players. Also, the game board 1 may indicate the player areas 2 by a means other than color. For instance, player areas may be designated by shapes, numbers, letters, etc. Similarly, the numbered area 6 may accommodate more than six letter tiles 8. In such an embodiment, the appropriate sided die or dice may be provided. In any one of the foregoing embodiments, players may have the option to select more than four letters from the letter tiles, in which case the score card 23 is modified accordingly.

In lieu of a die, any random selection means, such as a deck of cards, a spinner, a computer, etc., may be used which generates a set of indicia. The set of indicia may comprise a series of numbers, characters, colors, shapes, etc. Each player area of game board 1, instead of having a numbered area 6, will have a matching or identical set of indicia which corresponds to the indicia generated by the random selection means. Thus, when the letter tiles 8 are randomly placed around the game board 1 at the beginning of the game, each of the letter tiles 8 placed around the game board 1 will be aligned with each indicia provided in the player areas.

The word game of the present invention may be constructed of any material which is durable, and suitable for the particular playing environment. For instance, a home version of the game may include a sturdy cardboard, or plastic game playing board with similar materials for the letter tiles. A travel version of the game may be smaller, and may include such features as velcro, or magnetic pieces so that game may be more easily played during travel. Another version for children may include a letter selection based on words used frequently by children. The children's game may further included larger letter tiles to prevent accidental swallowing of the pieces. Other versions of the game may include a letter selection based on topical or interest areas or based on other languages such as Spanish, Russian, etc.

As is appreciated by those skilled in the art, various changes and modifications may be made to the illustrated embodiments without departing from the spirit and scope of the present invention. Therefore, all such modifications and changes are to be covered by the appended claims.

What is claimed is:

1. A word game apparatus comprising:

a plurality of letter tiles, each imprinted with at least one letter;

a game board having a plurality of player areas, each of the player areas being provided with an identical set of indicia for identifying a position for placement of one or more of said letter tiles around the board and adjacent to one or more of said player areas during game play; and a selection means for randomly selecting at least one of said letter tiles placed adjacent to said one or more of the player areas.

2. The word game apparatus of claim 1, further comprising a score card for recording and forming words from the selected letters.

3. The word game apparatus of claim 1, wherein the letter tiles are imprinted with letters on both sides of each tile.

4. The word game apparatus of claim 1, wherein the letter tiles are thirty-one in number.

5. The word game apparatus of claim 4, wherein the letters selected to be imprinted on the tiles have the relative frequency of about seventy percent commonly used consonants, about twenty-four percent vowels, and about six percent rarely used consonants.

6. The word game apparatus of claim 1 wherein the game board has four player areas.

7. The word game apparatus of claim 1 wherein the selection means comprises a six-sided die.

8. The word game apparatus of claim 7 wherein said set of indicia in each player area comprises the numbers one through six imprinted on said game board.

9. The word game apparatus of claim 1 wherein each of said tiles placed around said board is aligned with indiciurm of one of said sets of indicia.

10. The word game apparatus of claim 1 further comprising a bomb tile, said bomb tile having an illustration of a bomb depicted on at least one side thereof.

11. The word game apparatus of claim 2 wherein the score card further comprises a plurality of letter saving boxes.

12. The word game apparatus of claim 11 wherein the score card further comprises one or more sentence forming lines.

13. The word game apparatus of claim 9, further comprising:

a plurality of tile placement areas, each of said tile placement areas being adjacent to a different one of said player areas;

wherein each of said letter tiles placed around said board and aligned with said indicium of one of said sets of indicia, is placed within one of said tile placement areas.

14. The word game apparatus of claim 1 further comprising a pointing finger tile having an illustration resembling a pair of pointing fingers depicted on at least one side thereof.

15. A word game apparatus comprising:

a plurality of letter tiles, each imprinted with one letter on each side of the tile;

a game board having a plurality of player areas, each of said player areas being imprinted with the numbers one through six, wherein one or more of said letter tiles is positioned around said game board and adjacent to one or more of said player areas during game play, each said positioned letter tile being aligned with one of the numbers imprinted on the corresponding player area; and a six-sided die for selecting one or more of the letter tiles positioned around said game board by randomly selecting the numbers one through six.

16. The word game apparatus of claim 15 wherein said plurality of the letter tiles are thirty-one in number and the letters imprinted on the letter tiles occur with a relative frequency of about seventy percent commonly used consonants, about twenty-four percent vowels, and about six percent rarely used consonants.

17. A method for one or more players to play a word forming game comprising the steps of:

providing a plurality of letter tiles each having at least one letter imprinted on at least one surface;

providing a game board having a plurality of player areas, each player area having an identical plurality of position indicia thereon;

placing a plurality of letter tiles adjacent to said player areas so that each letter tile is aligned with one of the position indicia in the player areas;

completing one round of said game, said step of completing comprising the steps of:

randomly selecting a plurality of letter tiles from the placed letter tiles in the respective player areas; and forming one or more words from the selected letters in the respective player areas.

18. The method of playing a word forming game according to claim 17 wherein each player selects four letter tiles during said step of randomly selecting a plurality of letter tiles.

19. The method according to claim 17 further comprising the step of;

repeating said steps of randomly selecting a plurality of letter tiles and forming one or more words from the selected letters as required to play eight rounds of said game.

20. The method according to claim 19 further comprising the step of;

turning over all the placed letter tiles after round four.

* * * * *